United States Patent [19]

Goldhaber

[11] 3,978,614

[45] Sept. 7, 1976

[54] CASEMENT COVERING

[76] Inventor: Marvin L. Goldhaber, 10005 Talbot, Huntington Woods, Mich. 48070

[22] Filed: Dec. 10, 1973

[21] Appl. No.: 423,273

[52] U.S. Cl. ..... 49/55; 52/202

[51] Int. Cl.[2] ..... E06B 3/30; E06B 7/00

[58] Field of Search ..... 49/57, 55, 61, 62, 463; 52/202, 203; 85/45

[56] References Cited

UNITED STATES PATENTS

| | | | |
|---|---|---|---|
| 2,208,718 | 7/1940 | Bayley | 49/57 X |
| 2,222,667 | 11/1940 | Kitzelman | 49/57 |
| 2,266,973 | 12/1941 | Horton | 52/202 |
| 2,631,698 | 3/1953 | Buckwalter | 49/62 |
| 2,654,128 | 10/1953 | Day | 49/463 X |
| 2,834,071 | 5/1958 | Camerino | 52/202 X |
| 3,028,638 | 4/1962 | Goellner | 52/203 X |
| 3,214,879 | 11/1965 | Ellingson, Jr. et al. | 52/202 X |
| 3,305,623 | 2/1967 | Bakker et al. | 52/202 X |

FOREIGN PATENTS OR APPLICATIONS

| | | | |
|---|---|---|---|
| 943,521 | 12/1963 | United Kingdom | 85/45 |

*Primary Examiner*—Philip C. Kannan

[57] ABSTRACT

A casement covering comprising a metal frame rigidly secured to glazing, the glazing being substantially shatter resistant, and means securing the apparatus to a casement comprising fasteners that cannot be removed by an ordinary screwdriver.

4 Claims, 21 Drawing Figures

15

CASEMENT COVERING

This invention relates generally to casement coverings. More particularly, this invention relates to casement coverings comprising substantially shatter resistant glazing enclosed by metal frames and secured to the casement by fasteners that cannot be readily removed by ordinary screwdrivers.

Ownership of buildings, particularly homes, often presents an attractive target for burglars or other persons attempting to make illegal entry or unwarranted entry into such buildings. The problem is particularly acute when the buildings are uninhabited either for a short or for a long period of time. The problem is even more acute in urban areas where a substantially high rate of crime, including illegal entry and burglary into buildings, is frequently encountered.

The problem of defending against such illegal entry and burglary becomes particularly acute when there are a large number of buildings involved spread out over a wide area. Short of placing a guard in every such building, a very expensive and sometimes impractical regardless of expense alternative, or the provision of extensive and expensive burglar alarms, prior to this invention, there has been no adequate solution to the problem. Even extensive burglar alarms do allow the burglar or illegal entrant to gain initial access to the interior of a building. Whether he is subsequently frightened off by means of an internally generated alarm or by the rapid approach of police or other security officials, such an illegal entrance has already done damage to the interior of the property. What is worse, sometimes these alarm systems do not work properly in which no alarm is given, and therefore no deterrent is provided for the continuing staying of the illegal entrant, or, a similar result is obtained because of a delay in reaching the premises by security or police officials after the alarm is given.

Another alternative solution that has been attempted in the past to provide security against illegal entry is the boarding up of houses that have become either abandoned or uninhabited for brief or long periods of time. The difficulty with this solution is that it is very easy for a determined burglar or illegal entrant to simply remove the boards and enter the building. This can be accomplished by merely using the claw end of an ordinary hammer, a screwdriver, or simply breaking the boards or sawing through them. Very little time is required for a determined illegal entrant to gain access to a building that is boarded up.

Attempts have been made in the past to provide double glazing or double windows for purposes other than maintaining security. The use of storm windows for this purpose is a common practice. Other double windows, some involving glass and some involving opaque materials, have been provided for purposes other than security of the building. These other purposes usually relate to heat insulation or to the reflection of intense heat applied against the exterior of the building reaching the interior. However, because either the casement coverings themselves can be readily removed by a screwdriver, claw hammer or other ordinary tool, or because the materials used in such double windows or double casements are either thin enough to be readily punched or broken or breached, or are thick but made of such a material that it is either readily shatterable such as ordinary glass, or are of a soft nature such as wood that can be readily drilled or breached, the net effect is one of very little hindrance or deterrent to a determined illegal entrant.

The scope of the problem and the failure of the above indicated methods to reduce the scope of the problem significantly can be appreciated in a single urban area such as Detroit, Michigan where literally tens of thousands of houses have been abandoned or rendered uninhabited, and where practically all of these houses have become burglarized or otherwise destroyed, and valuable materials removed from the interior thereof to such an extent that the resultant value of the houses has been substantially reduced.

The scope of the problem can be further appreciated by the fact that hundreds of thousands of householders feel insecure in leaving their homes even for a brief one or two week vacation because there is no readily available means of providing security to their homes in their absence to defend against illegal entry or burglary. Many of these householders cannot afford expensive and elaborate burglar alarm systems, nor can they afford to hire a guard to stand on the premises during the time of their absence. Nor have any of the cheaper solutions indicated above been sufficient to provide any relief from the hazards of burglary and illegal entry during a brief absence of a vacation.

The scope of the problem can be further appreciated from the problem of people owning summer homes and cottages remote from urban areas and which are uninhabited during most of the year. During the seasons in which these homes and cottages are unused, it has been a common practice to utilize the procedure of boarding up such homes. However this boarding up, as indicated above, is ineffective against a determined illegal entrant or burglar. Furthermore, burglar alarm systems are not appropriate for such homes because they are remote from police or other security officials who would be notified by such burglar alarms and who could not reach such premises in sufficient time to prevent substantial damage from an illegal entrant or burglar.

Accordingly, it is an object of this invention to provide a secured window casement or door casement covering that cannot be removed except by the provision of a special tool that will only be distributed to those who have authorization to enter the building on which the casement coverings are provided and which further comprises substantially shatter resistant materials covering the casement that cannot be readily broken or breached with ordinary tools such as a screwdriver or hammer.

It is another object of this invention to provide a window or door casement covering that is substantially shatter resistant and break resistant and that cannot be removed by ordinary tools and which further can be removed by special tools within authorized person's hands within a relatively brief period of time.

It is a still further object of this invention to provide a burglar or illegal entrant resistant casement covering for buildings that can be readily installed and removed relatively inexpensively and in a relatively uncomplicated manner by the use of special tools that will be provided only to authorized persons.

It is still another object of this invention to provide a secured window casement covering that cannot be removed except by persons authorized to have special tools and which is capable of being made, maintained, and used in a relatively inexpensive, uncomplicated, and efficient manner.

It is still another object of this invention to provide a secured window casement covering that cannot be removed except by persons authorized to have special tools that presents a relatively attractive appearance and which has substantial translucent or transparent portions.

It is yet another object of this invention to provide a secured casement covering for a doorway wherein the casement covering contains at least one lock to which access cannot be made for locking or unlocking or for insertion or removal of a key without the use of a special tool to remove a covering for such locking means.

It is still another object of this invention to provide a secured door casement covering that is substantially transparent and that can be unlocked only by the use of a special tool to remove a covering of the keyway for locking mechanism.

These and other objects of this invention are achieved by the provision of a substantially shatter resistant material enclosed by a metal frame that is rigidly fixed to the shatter resistant material and the provision of fasteners for fastening the resultant structure within the casement but exterior to the window or door originally within the casement and the use of fasteners for so placing the casement covering that it cannot be removed except by the use of special tools which will be distributed only to authorized persons preventing removal by ordinary tools such as a hammer, screwdriver, crowbar, or manually actuated drill.

These and other objects of this invention can be further appreciated from the following specifications and claims.

ON THE DRAWINGS

Before explaining the present invention in detail, it is to be understood that the invention is not limited in its application to the details in construction and arrangement of parts illustrated in the accompanying drawings since the invention is capable of other embodiments and of being practiced or carried out in various ways.

Also, it is to be understood that the phraseology and terminology employed herein is for the purpose of description and not of limitation.

AS SHOWN ON THE DRAWINGS

Figure 14:
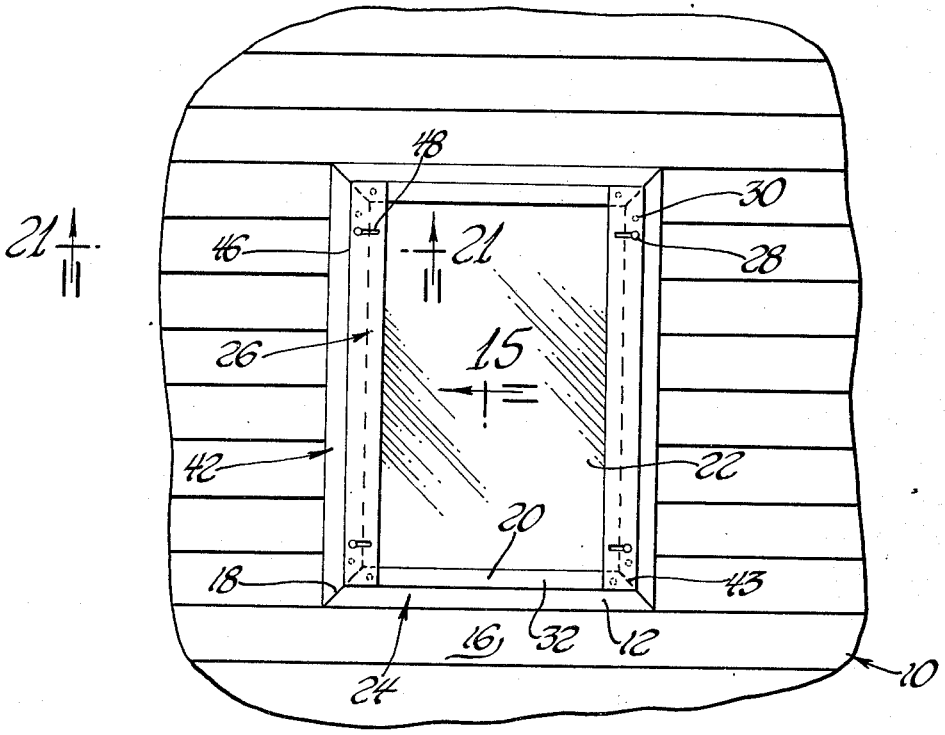
FIG. 14 is a front view of an alternative embodiment of this invention.
Figure 15:
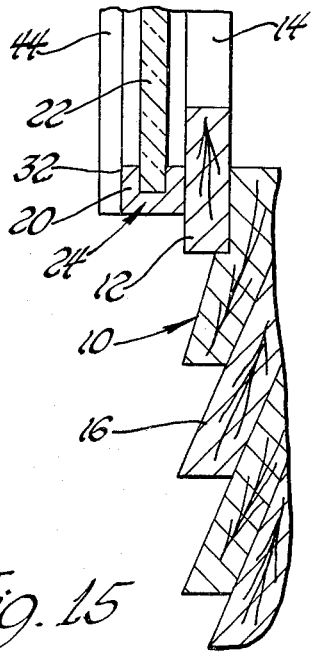
FIG. 15 is a partial transverse sectional view of the apparatus shown in FIG. 14.
Figure 16:
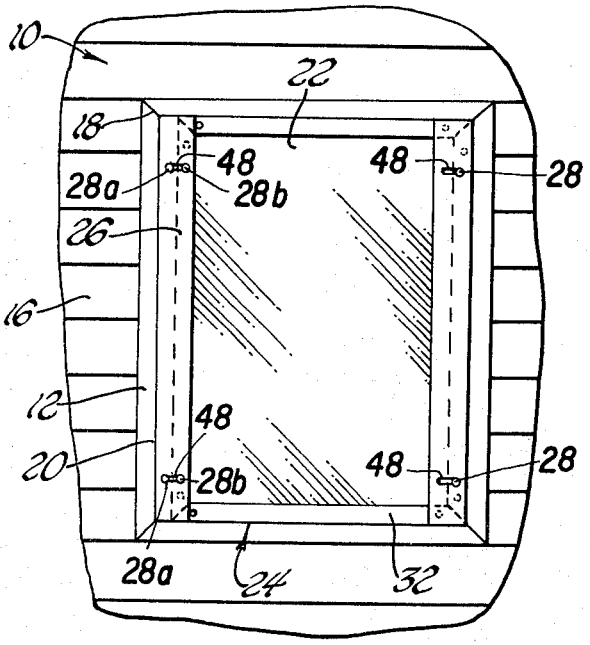
FIG. 16 is a front view of an alternative embodiment of this invention shown in an alternative application.
Figure 17:
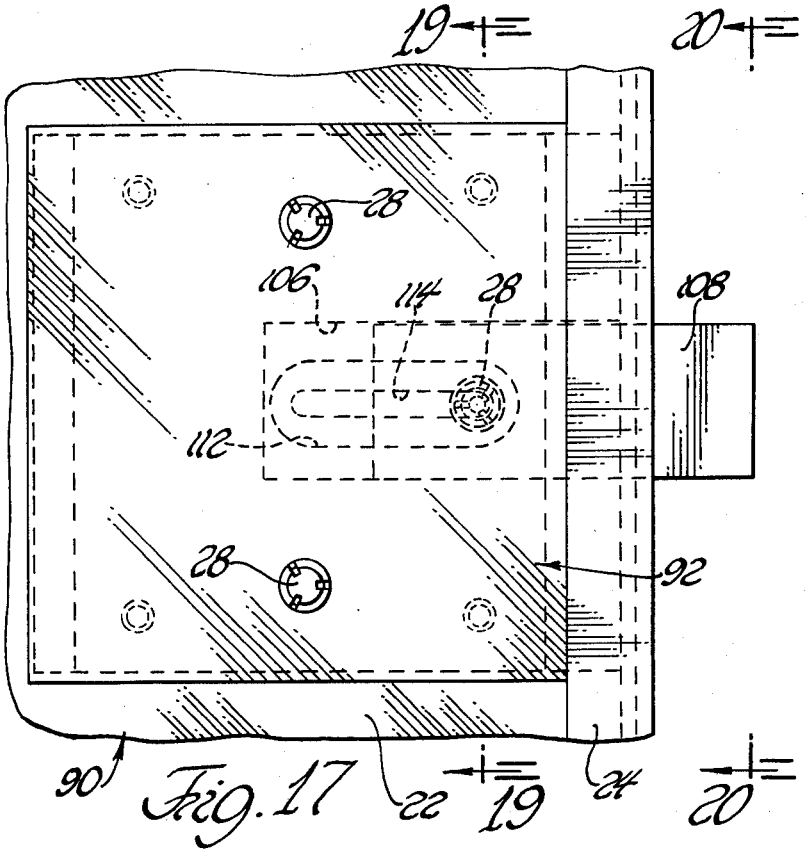
FIG. 17 is a partial top plan view of another alternative embodiment of this invention.
Figure 19:
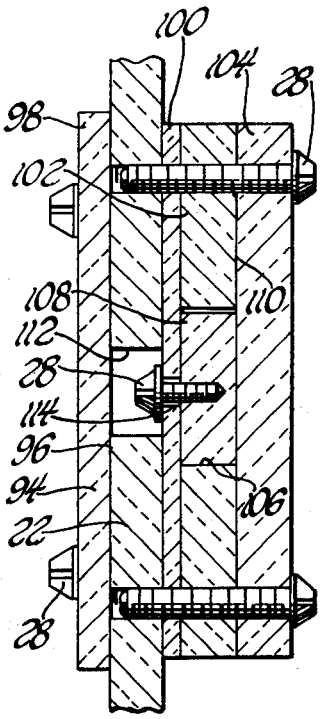
FIG. 19 is a partial transverse sectional view of the apparatus shown in FIG. 17.
Figure 18:
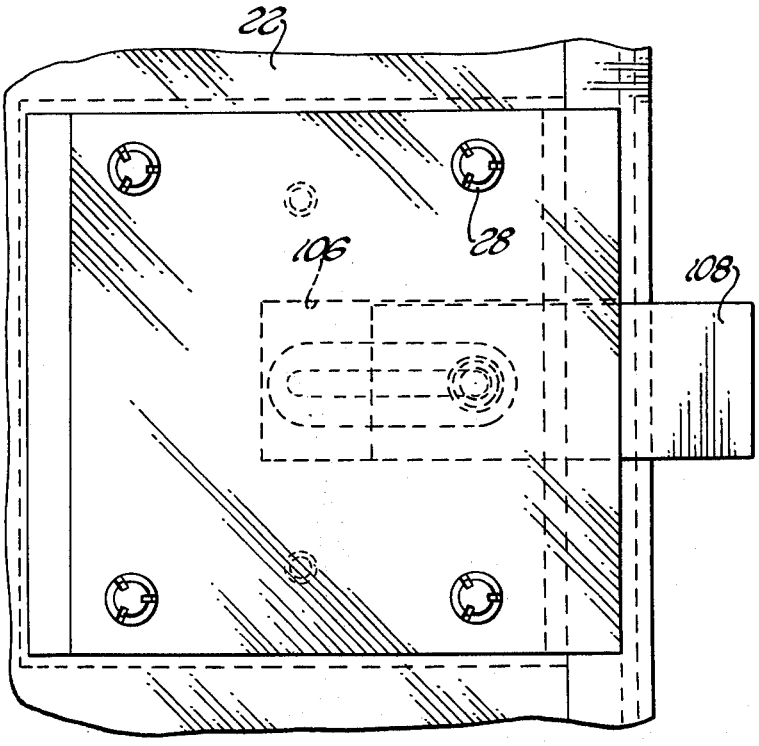
FIG. 18 is a partial bottom view of the apparatus shown in FIG. 17.
Figure 20:
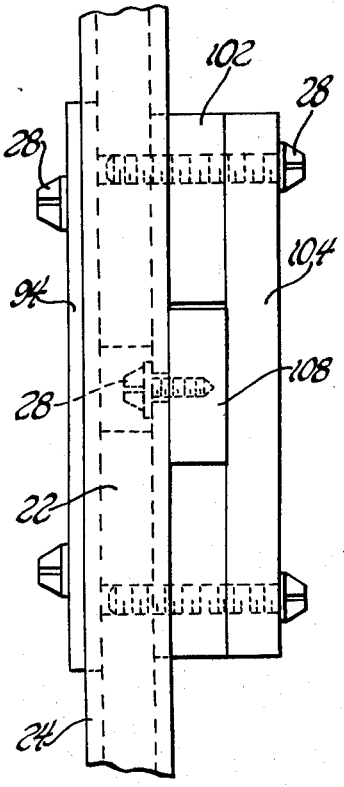
FIG. 20 is a side view of the apparatus shown in FIG. 17.

A preferred embodiment of the invention is shown in FIGS. 14, 15 and 16. A housing structure 10 has a window casement 12 enclosing a window 14.

The exterior surface 16 of the housing structure 10 may be in the form of wood or aluminum siding, brick, stone, or other appropriate housing exteriors commonly found in a variety of housing structures, particularly residential homes. The casement structure 12 often is a rectangularly shaped enclosure fixed to the sliding 16 by means of nails or other appropriate fixing means. Typically the casement structure 12 comprises four boards arranged in an open rectangular frame having mating beveled edges 18 formed at approximately 45° with respect to the longitudinal edges of the four frame members making up the casement portion 12. In this ordinary structure that has been common in the past, it is a relatively simple matter for a determined burglar to simply break the relatively non-shatter resistant glass 14 contained within the casement 12.

In the aforementioned FIGS. 14 through 16 the preferred embodiment of this invention is referred generally at numeral 20. This embodiment is an additional exterior window structure that is fixed to the casement 12 in a manner to be described hereinafter.

The window structure 20 comprises a window portion 22, a window frame structure 24, frame extension members 26, limited deactuatable fastener members 28, and rivet fasteners 30.

The glass portion 22 is not meant to refer to the usual material referred to as glass, but rather refers to a translucent or transparent portion, commonly referred to in the construction industry as a lite. More particularly, the glass or lite portion 22, also referred to as glazing, is substantially shatter resistant, at least translucent if not transparent, plastic material such as a high shatter resistant plexiglass or plastic glazing such as LEXAN. "LEXAN" is a trademark applied by The General Electric Company of Pittsfield, Massachusetts to transparent safety glazing for use in buildings.

"PLEXIGLAS" is a trademark owned by the Rohm & Haas Company of Philadelphia, Pennsylvania and is applied to transparent safety glazing for industrial and architectural application.

"PLEXIGLAS" relates to thermoplastic poly-(methyl methacrylate)-type polymers.

"LEXAN" is a trademark used for thermoplastic carbonate-linked polymers produced by reacting bisphenol A and phosgene. It is polycarbonate resin.

The term polycarbonate refers to a synthetic thermalplastic resin derived from bisphenal A and phosgene, a linear polyester of carbonic acid: $(COOC_6H_5C(CH_3)_2C_6H_5O)_n$. This can be formed from any dihydroxy compound and any carbonate diester or biester interchange. Polymerization may be an aqueous emulsion or a non-aqueous solution. The properties of a polycarbonate include transparency of approximately 90% light transmission; non-corrosive; weather and ozone-resistant; non-toxic; stain-resistant; combustible but self-extinguishing; low water absorption; high impact strength; heat-resistant; high dielectric strength; dimensionally stable; soluable in chlorinated hydrocarbons when attached by strong alkalies and aromatic hydrocarbons; stable in mineral acids; insoluable in aliphatic alcohols. It is capable of being thermal formed and being molded by fluidized bed coating.

As used hereinafter, the term thermoplastic-type polymers refers to either the material such as "LEXAN" or "PLEXIGLAS" or similar materials.

Figure 1:
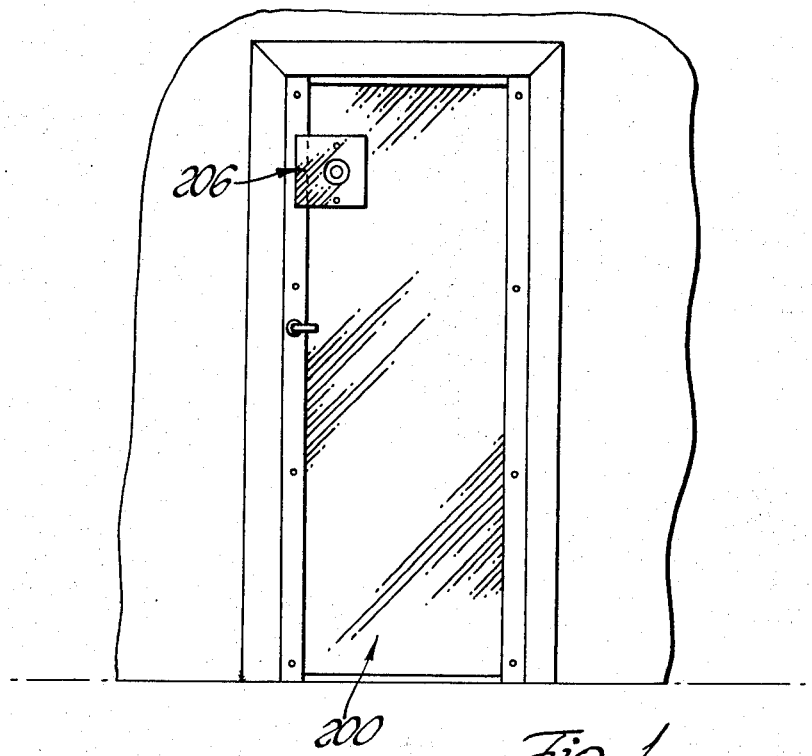
FIG. 1 is a front view of a preferred embodiment of this invention.
Figure 2:
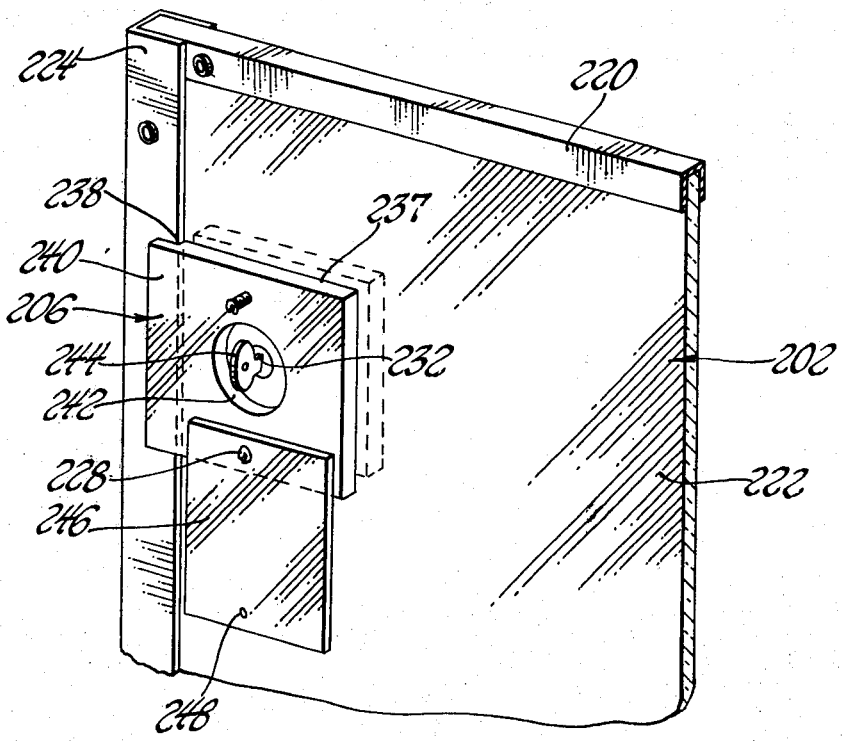
FIG. 2 is a three-dimensional partial view of the apparatus shown in FIG. 1.
Figure 3:
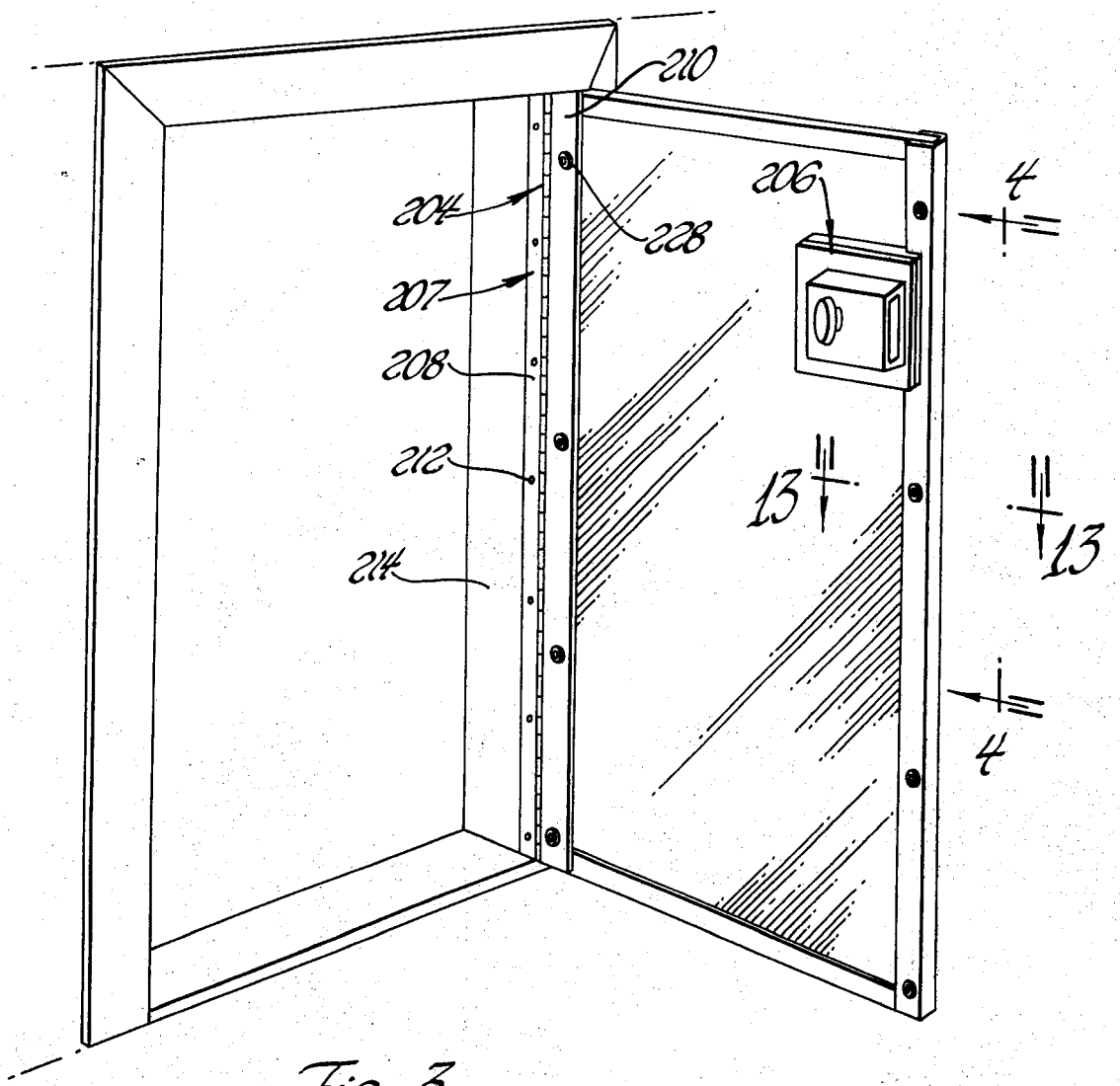
FIG. 3 is a three-dimensional view of the apparatus shown in FIG. 1 in an open condition.
Figure 4:
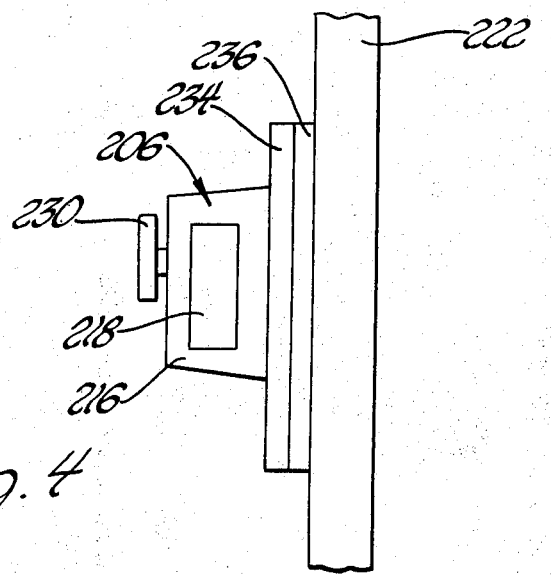
FIG. 4 is a side view of the apparatus shown in FIG. 3.
Figure 5:
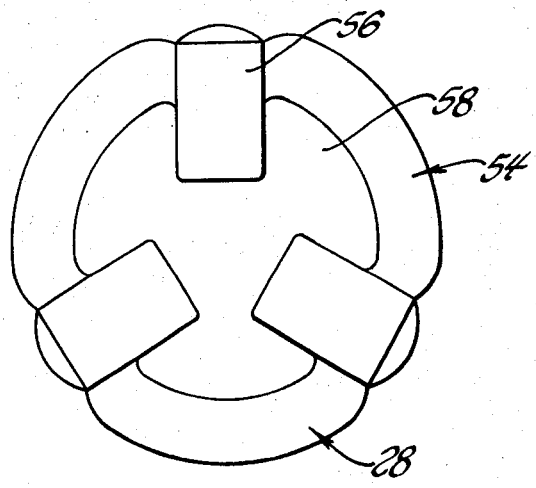
FIG. 5 is a top plan view of the head of a fastener used in the preferred embodiment of this invention.
Figure 6:
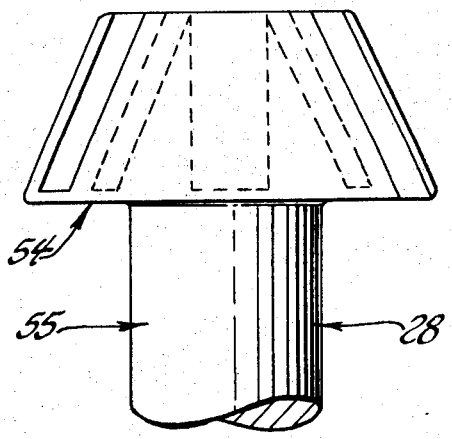
FIG. 6 is a partial side view of the apparatus shown in FIG. 5.
Figure 7:
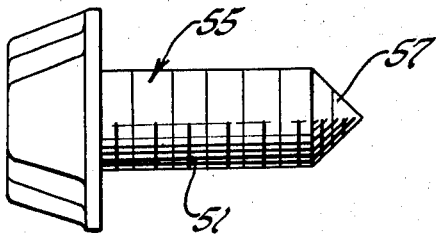
FIG. 7 is a side view of a fastener used in the preferred embodiment of this invention.
Figure 8:
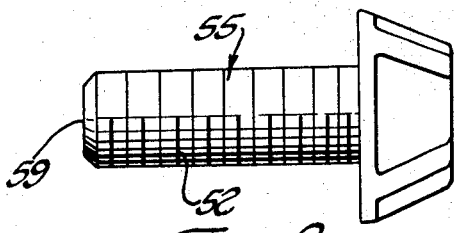
FIG. 8 is a side view of a fastener used in the preferred embodiment of this invention.
Figure 9:
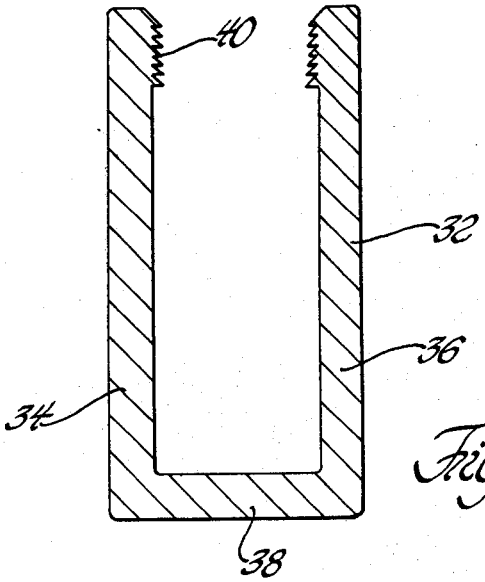
FIG. 9 is a cross-sectional view of an extrusion used in the preferred embodiment of this invention.

The window frame structure 24 comprises four channel members 32. One of these channel members 32 is shown in cross-sectional view in FIG. 9. Each of these channel members 32 is an aluminum alloy channel shaped member. Each of the channel members is made from an aluminum alloy such as aluminum alloy 6063T5, the SAE specification such as that utilized by International Extrusions, Inc. of Detroit, Michigan, which manufactures such extrusions.

Each of the channel members 32 has leg members 34 and 36 extending from a base portion 38. Near the ends of the leg members 34 and 36 opposite from the ends thereof integral with the base portion 38, are a plurality of inwardly extending ridge and valley portions 40. When the channel member 32 is assembled with the glazing portion 22, the ridge and valley members 40 engage the surface of the glazing material proximate thereto and provide a rigid gripping effect thereon.

The window frame structure 24 comprises four of the aforesaid channel members 32 that have 45° beveled end portions to correspondingly mate with one another at the corners of the resultant frame structure to give a resultant rectangularly shaped frame. The window frame structure 24 is secured to the glazing portion 22 by means of fasteners 30 that are preferably aluminum pop rivets. In the preferred embodiment of this invention relating to window structures, an aluminum pop rivet is provided near the beveled end portion 43 of each of the four aluminum channel members 32 that make up the frame structure 24.

It would be possible to attach the combination of the glazing portion 22 which is fixed within the window frame structure 24 directly over casements holding windows or doors. However, because such casements often vary in their dimensions, it is preferable to provide some sort of extension means on the frame structure 24 to allow for different sizes and variations of width to height ratios of casements so that a single structure 20 can be utilized for a variety of casement openings that vary from one another with regard to height to width ratios. Accordingly, in the preferred embodiment of this invention relating to windows, frame extension members 26 are provided. These frame extension members comprise aluminum alloy bracket members 42 that have an externally facing horizontal portion 44 and a vertically extending leg portion 46 substantially perpendicular to the horizontal facing portion 44 and on one side of each of the bracket members 42.

The bracket members 42 also have slot portions 48 near the top and bottom thereof that constitute apertures through which can be passed fastening members 28.

The preferred form of the limited deactuatable fastener members 28 is shown in FIGS. 5 through 8. These fastening members may selectively connect the glazing structure 22, the frame structure 24, and the extension members 26, or, alternatively, depending upon the relative configuration of the window casement structure with regard to the height and width dimensions of the combination of the glazing material 22 encased within the frame structure 24, the limited deactuatable fastener members 28 might also connect such of the aforementioned structure directly to the casement 12.

The bracket members 42 are preferably made of an aluminum alloy such as aluminum alloy 6063T5, the SAE specification such as that utilized by International Extrusions, Inc. of Detroit, Michigan, which manufactures such extrusions.

FIG. 14 illustrates an application of the window structure 20 to a casement that has height and width dimensions that correspond in ratio of height width to the height and width dimensions and the height width ratio of the window structure 20. FIG. 16 shows the application of the window structure 20 to a casement where the height and width dimensions of the casement are such that the height width ratio is smaller than the height width ratio of the window structure 20. Accordingly, in FIG. 16, the extension members 26 are extended on one side to cover the greater width proportion of that casement, and additional limited deactuatable fastener members are applied in the slot portions 48. Thus, in FIG. 16, six of these limited deactuatable fastener members are utilized, two in the slot portion 48 on the left side of the window structure 20, and one in each of the slots 48 on the right side of the window structure 20. The leftmost limited deactuatable fastener members **28*a* fix the bracket member 42 on the left side directly to the casement 12. The limited deactuatable fastener members 28 on the right hand side of the window structure 20 also pass through the slot 48, through the channel member 24, through the glazing material 22, and rigidly fix the structure to the casement 12. The limited deactuatable fastener members 28*b* on the left side of the casement structure but to the right of the aforementioned leftmost deactuatable fastener members 28*a*, connect and rigidly secure to one another the bracket member 42 on the left side of the window structure 20, the channel member 24, and the glazing material 22, but do not pass through the inner side of the window structure 20, and consequently do not attach directly to the casement 12. This allows for the securing of the window structure 20 to the casement 12 where glazing material 14 in the window to be covered may be directly behind the fastener members 28*b* located on the right hand side of the leftmost slots 48 in the leftmost bracket member 42 on the window structure 20.**

It can be observed that in FIG. 14, only four limited deactuatable fastener members 28 are utilized, one in each of the slots 48, and in each case, these fastener members 28 pass through the slots 48 in the bracket member 42, secure the bracket member 42 to the channel member 24 and the glazing material 22 and rigidly secure the window structure 20 to the casement 12 by passing through and rigidly adhering to the casement structure 12.

Figure 11:
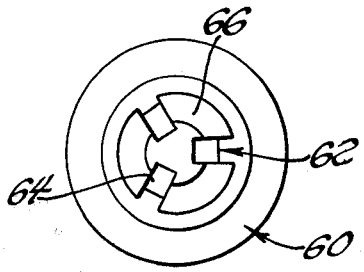
FIG. 11 is an end view of a tool attachment used in the preferred embodiment of this invention.
Figure 12:
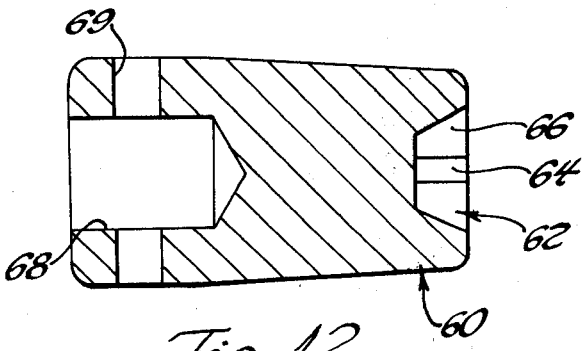
FIG. 12 is a transverse sectional view of the apparatus shown in FIG. 11.

The limited deactuatable fastener members 28 are shown in their preferred embodiment in FIGS. 5 through 8. These are "tamper-proof" fasteners made under the trademark TAMPRUF, manufactured by the Jefferson Screw Corporation of New York, New York. The head portion 54 of the fastener member 28 comprises three slots 56 separated by approximately 120° from each other and positioned on the radially outward portions of the head portion 54. A barrier 58 separates the slots 56 and is in the shape of an upstanding frustral conical section with the slots 56 within them. Two versions are shown, a version with a biting conical end portion 57 and indicated as version 51 in FIG. 7, and a version 52 having a substantially flat end portion 59 shown in FIG. 8. The biting end of version 51 is utilized when it is desired that the shank portion 55 of the fastener member 28 pass through a window structure 20 and be fixed to the casement 12. The flat end version 52 is utilized when it is desired to secure the bracket member 42 to the rest of the window structure 20 without passing through and digging into the casement 12 but yet allowing the shank 55 to pass through the outward channel member portion 24, the glazing portion 22, and the inner channel leg of the channel portion 24 in such a manner that the end of the flat surface 59 is flush with the inner surface of the window structure 20 that is closest to or contiguous to either the casement 12 or the glazing 14 that it covers. The advantage of using limited deactuatable fastener members such as those shown in FIGS. 5 through 8 is that it requires a special tool to remove these screws. The end portion of such a tool is shown in FIGS. 11 and 12 and is referred to by numeral 60. The tool engaging portion 60 has fastener head engaging portion 62 that has a shape that corresponds in a male-female relationship to the outer surface of the head 54 of the fastener members 28.

Figure 10:
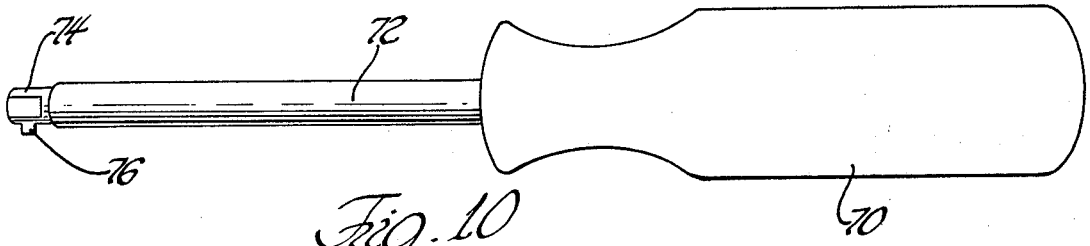
FIG. 10 is a side view of a tool used in the preferred embodiment of this invention.

It can be observed from the drawings that the engaging head 62 of the tool portion 60 has tab portions 64 that engage the slots 56 of the head of the fasteners 28 and also that the head portion 62 has depressions 66 that mate and engage the projecting barriers 58 on the head of the fasteners 28. A hand tool 70 is shown in FIG. 10 which has a stem portion 72 and an end portion 74 at the driving end of the tool 70. It can be appreciated that the end portion 74 engages a receptacle portion 68 on the end of the tool portion 60 opposite from the fastener engaging portion 62. A projection 76 on the end portion 74 will engage apertures 69 at the receptacle end of the tool portion 60. It can be appreciated that the manual tool member 70 can be fixedly engaged with the tool portion 60 by insertion of the end portion 74 into receptacle 68 and locking of the tab portion 76 with the aperture 69 such that when the fastener engaging surface 62 engages the fastener member 28 on the head portion 54 thereof, a rotation applied to the manual tool member 70 will be imparted by the tool portion 60 to the fastener member 28 to allow rotation of the fastener member for either fixedly engaging the window structure 20 to the casement portion 12 or for the deactuation of that fastening by counter-rotation.

Alternatively, instead of using the manual tool portion 70, a power tool having a portion like the stem portion 72 and an end portion like the end portion 74 and a tab portion like the tab portion 76, can engage the tool portion 60 in a manner similar to the manual tool 70 so engaging, and electric power rotating the shaft 72 will impart rotation through the tool portion 60 to the fastener member 20 in a like manner as in the manual actuation described above.

Figure 13:
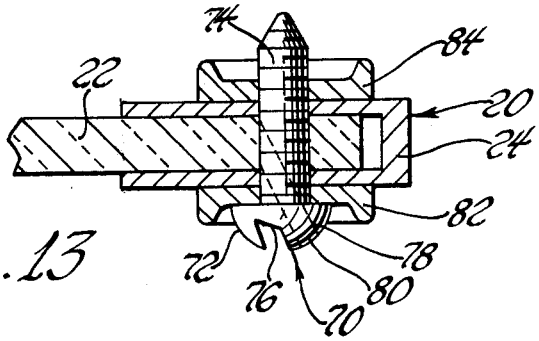
FIG. 13 is a partial cross-sectional view of a portion of an alternative embodiment of this invention.
Figure 21:
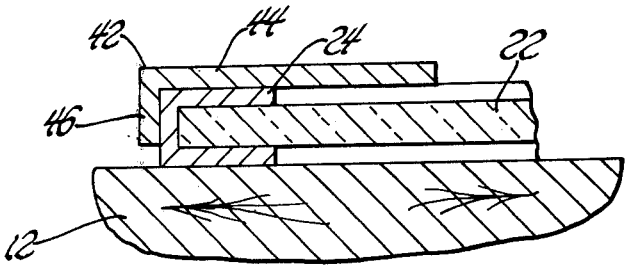
FIG. 21 is a cross-sectional view of a portion of the apparatus shown in FIG. 14.

An alternative form of the limited deactuatable fasteners 28 is the limited deactuatable fastener 70 shown in FIG. 13. The fastener comprises a fully rounded head 72 on a bolt stem 74 that is threaded. A notch 76 is provided that cannot be actuated by an ordinary screwdriver. An aperture 78 is drilled in the steel bolt and is filled with a lead portion 80. In order for the screw to be removed an auger must be inserted into the leaded portion 80 and threadedly drawn into the bolt and then rotated in the opposite direction for counter-rotation of the entire stem 74 to remove the element 70. As can be seen in FIG. 13, when this type of fastener 70 is utilized in place of the limited deactuatable fasteners 28 and washers 82, 84 are provided on the exterior and interior faces respectively of the window structure 20. The fastening member 70 secures the washers 82 and 84 to the channel member 24 and passes through the glazing material 22.

An alternative embodiment of the invention is illustrated in FIGS. 17 through 20. In this embodiment, a door 90 is provided with a locking mechanism 92.

The door 90, exclusive of the locking mechanism 92, is made in a manner similar to the window structure shown in FIGS. 14 through 16. A glazing material 22 similar to the glazing material used in the aforementioned window structure 20 is utilized. A channel member 24 made of aluminum alloy is similar to that utilized in the aforementioned window structure 20. The channel member is secured to the window structure by pop rivets or other appropriate securing means.

The locking structure 92 comprises a forward cover plate 94 made of the same material as the glazing material 22, namely a lexan-type of material. The cover plate 94 is painted along its interior side 96. This paint presents an opaque surface and makes it difficult for a burglar to see what the locking mechanism is since he can't see through the paint. Moreover by providing the paint on the interior surface that is the closed surface away from the exterior surface 98, it is impossible to scrape off the paint without first going through the tough lexan material. The interior surface 96 is immediately adjacent the glazing 22 of the door 90. More particularly, the interior surface 96 of the plate 94 is substantially flush against the exterior surface of the glazing 22.

A shim 100 is provided on the opposite or interior side of the glazing 22. The shim 100 has a thickness corresponding to the thickness of the channel member 24 and provides a partial support surface for the next and most interior piece, the guide way or guide member 102. The shim 100 and the guide way 102 are also preferably made of a material similar to the glazing 22, namely a lexan kind of material. A back cover plate 104 is secured to the inner surface of the guide 102. An aperture 106 is provided in the guide 102 that has a substantially rectangular configuration and allows for the sliding of a locking block 108 within the aperture 106. The interior surface 110 of the back cover plate 104 is painted and also hinders observation of the locking mechanism contained between the cover plates 94, 104. Again, by having the painting on the exterior side, that is the side closest to the glazing of the plate 104, the painted surface is at least removed by the thickness of the plate 104 from possible scraping away to view the mechanism between the cover plates.

The glazing 22, shim 100, guide way 102 and back cover plate 104 are secured preferably by four of the fastening members 28 of the limited deactuatable variety described above. The front cover plate 94 is secured to the glazing 22, shim 100, and guide member 102 by means of limited deactuatable securing members 28 inserted in the opposite direction to the immediately aforementioned, one securing the back cover plate 104.

An aperture 112 of an oval-type shape is cut into the glazing member 22 and allows for access to a limited deactuatable member 28 that is rigidly secured to the sliding block member 108. The stem portion of the limited deactuatable fastening member 28 passes through another aperture that is also oval shaped but has a smaller width as indicated by the numeral 114 that passes through the shim 100. It can be seen that the width of the aperture 112 in the glazing must be substantially wider than the width of the aperture 114 in the shim 100 because the latter must accommodate only a width slightly greater than the stem of the fastening member 28 while the former must be wide enough to accommodate the width greater than the greatest width of the head portion of the limited deactuatable fastener member 28.

From the immediately above description it can be appreciated that the sliding block 108 can be moved back and forth within the aperture 106 by means of applying appropriate horizontal forces on the head of the fastener member 28 which is secured to the block 108.

It can also be appreciated that access to the limited deactuatable fastener member 28 that is attached to the sliding block 108 can be had only by removal of the cover plate 94. Since a special tool, as described above, is required for the removal of the fastening members 28 that hold the cover plate 94 to the rest of the structure, it can be appreicated that only someone who has access to the special type of tool required will be able to readily disassemble the locking mechanism 92.

An alternative embodiment of the invention is shown in FIGS. 1 through 4. This alternative embodiment indicated by numeral 200 comprises a door-like structure 202 encased or attached to a casement fixed apparatus 204 and having a locking mechanism 206. The apparatus 202 comprises a frame structure 220 which is rigidly attached to a glazing material 222 and which is fixed to an extension structure 224. The glazing material 222 is similar to the material 22 hereinbefore described. The frame structure 220 is similar to the structure 20 hereinbefore described. The extension members 226 are similar to the extension members 26 hereinbefore described. The casement fixing apparatus 204 comprises a hinge member 207 having a casement secured leaf 208 and a door secured leaf 210. The door secured leaf is fixedly secured to the extension member 224. This securing is done by means of limited deactuatable fasteners 228 similar to limited deactuatable fastener members 28 hereinbefore described. Rivets 212 secure leaf 208 to the casement 214.

It is preferred that the structure 200 is located internally within and recessed within the casement structure 214 with respect to the outside so as to make it difficult to have access to the rivets 212. The latching mechanism 206 comprises an ordinary door latch mechanism 216 having a bolt 218 which is actuatable interiorly within the house by means of a knob 230 or by means of turning a lock mechanism 232. The lock mechanism 206 is preferably made of metal but can also be the type of lock mechanism disclosed in FIGS. 17 through 20 and indicated generally by numeral 92.

The lock mechanism 206 has the metal portion thereof 216 located on the interior side of the door and fixed to a lexan-type of material shim member 234 which in turn is flush against a second shim member 236 and which further in turn is flush against the glazing material 222. A third shim member 237 has a jogged edge portion 238 proximate the junction of the edge of extension member 224 and the glazing material 222 and consequently an overlapping portion of the shim member 238 extends as indicated by numeral 240 over the extension portion 224. A circular aperture 242 is provided within shim member 236 for access via a key member 244 to lock and unlock the mechanism 216. A cover plate 246 is secured by limited deactuatable fastening members 228 to the balance of the locking structure 206. The plate 246 is painted on the side thereof in closest proximity to the glazing member 222 in order to obstruct viewing of the workings of the lock mechanism 216 from the outside of interior.

From the immediately foregoing description of the door apparatus 200 it can be appreciated that a door has been provided which allows for visual penetration to the interior of a housing structure without disclosing the locking mechanism 206 therewithin. It can also be appreciated that access to the lock can only be obtained by removal of the cover plate 246 by first removing the limited deactuatable fastener members 228 from corresponding apertures 248 in the cover plate in order to rotate the cover plate out from a position so that the lock is exposed and key can be inserted for opening the door.

From all of the foregoing specifications it can be appreciated that a variety of structures has been provided for controlled access to housing and other constructions whereby control is limited by means of limited distribution of special tools for removal of fastening members to locking mechanisms and to windows. It can also be appreciated that without access to these tools an unauthorized person will have difficulty in gaining entry to such houses and constructions, and at the very least will be inhibited in terms of the time necessary to break into such structures and dwellings.

It can also be appreciated that means for limited access to authorized personnel into a dwelling and business structures can be obtained by practice of this invention in a manner that is relatively inexpensive to make and utilize.

It can be appreciated that in using several of the aforementioned preferred and alternative embodiment of this invention, when it is desired to seal a dwelling, window structures such as those indicated in FIGS. 14, 15 and 16 can be applied to the window casements of all of the first and perhaps second story windows in the structure, and that one or possibly two door structures either of the type disclosed in FIGS. 1 through 4 with the locking mechanism 206 therein described or, alternatively, such a door structure with the locking mechanism disclosed in FIGS. 17 through 20, can be utilized that will provide means for gaining entry into the household by persons with authorized tools and prevent such entry or inhibit such entry by those without access to specialized tools.

It can also be appreciated that means for securing the contents of the interior of a structure can be obtained by practice of the foregoing invention by the implementation of the aforementioned door/window structures by inserting the limited deactuatable fasteners by means of specialized tools, and the removal of such structures by again implementing such tools. The result structure, when covered by the aforementioned window and door structures, is done so in a relatively aesthetic manner, that is at least more attractive than boarding up, and more effective and secure against unauthorized entry than boarding up or other methods that have been utilized in the past.

I claim:

1. A protective window unit formed to fit in window casements of varying sizes on the outside face of a conventional window, said window unit comprising:

a peripheral member having an inner channel;

a transparent shielding material, the edges of which are mounted in said channel and enclosed by said peripheral member, said shielding material being of sufficient strength to prevent entry through said window;

first threaded fasteners extended through both said peripheral member and the edge portion of said shielding material to attach said window unit to said casement;

laterally displaceable side members positionable on the outer side faces of said peripheral member for enclosing any space between the sides of said unit and said casements; and second threaded fasteners extending through said laterally displaceable side members securing same to said casement, said side members being so sized as to cover up the first memtioned threaded fasteners that are located on or in close proximity to said sides of said unit.

2. The protective window unit defined in claim 1 wherein said transparent shielding material is fabricated from a shatter-resistant material.

3. The protective window unit defined in claim 1 wherein said first threaded fasteners are of the tamper-proof type which prevent the unauthorized removal of said first threaded fasteners from said window unit.

4. The protective window unit defined in claim 1 wherein said second threaded fasteners are of the tamper-proof type which prevent the unauthorized removal of said second threaded fasteners from said window unit.

* * * * *